US007463256B2

(12) United States Patent
Meyer

(10) Patent No.: US 7,463,256 B2
(45) Date of Patent: Dec. 9, 2008

(54) AUTOMATIC PHASE ADJUSTMENT FOR DISPLAY

(75) Inventor: Corwyn R. Meyer, Sioux Falls, SD (US)

(73) Assignee: Gateway Inc., Irvine, CA (US)

( * ) Notice: Subject to any disclaimer, the term of this patent is extended or adjusted under 35 U.S.C. 154(b) by 181 days.

(21) Appl. No.: 10/125,937

(22) Filed: Apr. 18, 2002

(65) Prior Publication Data

US 2003/0197694 A1 Oct. 23, 2003

(51) Int. Cl.
*G09G 5/00* (2006.01)

(52) U.S. Cl. ..... 345/213; 345/204; 348/536

(58) Field of Classification Search ..... 345/3.4, 345/98, 99, 204, 211–213, 699; 348/536, 348/537, 540; 327/141, 142, 299
See application file for complete search history.

(56) References Cited

U.S. PATENT DOCUMENTS

| | | | | |
|---|---|---|---|---|
| 4,975,660 | A | 12/1990 | Svenson | 331/1 A |
| 4,991,023 | A | 2/1991 | Nicols | 358/242 |
| 5,965,990 | A | 10/1999 | Woo | 315/382.1 |
| 6,055,022 | A | 4/2000 | Hush | 348/529 |
| 6,097,379 | A | 8/2000 | Ichiraku | 345/213 |
| 6,107,984 | A | 8/2000 | Naka et al. | 345/99 |
| 6,115,009 | A | 9/2000 | Ikegami | 345/10 |
| 6,137,536 | A | 10/2000 | Yamaguchi | 348/521 |
| 6,219,023 | B1 | 4/2001 | Kim | 345/127 |
| 6,337,682 | B1 * | 1/2002 | Hwang | 345/213 |
| 6,348,931 | B1 * | 2/2002 | Suga et al. | 345/699 |
| 6,483,447 | B1 * | 11/2002 | Eglit | 341/111 |
| 6,483,502 | B2 * | 11/2002 | Fujiwara | 345/213 |
| 6,633,283 | B2 * | 10/2003 | Fukuda et al. | 345/204 |
| 6,700,570 | B2 * | 3/2004 | Tachibana et al. | 345/213 |
| 6,704,009 | B2 * | 3/2004 | Tachibana et al. | 345/213 |

* cited by examiner

*Primary Examiner*—Regina Liang
(74) *Attorney, Agent, or Firm*—Ross F. Hunt, Jr.; Stites & Harbison PLLC

(57) ABSTRACT

Autophase adjustment is initiated in a display device that digitally displays analog video signals. The autophase adjustment is initiated based on monitoring of at least one of the horizontal and vertical synchronization signal pulse rates and polarity. When a change is detected in either of the horizontal and vertical synchronization pulses, an autophase adjustment is automatically initiated. Correct phase settings are obtained from a table of settings cross referenced by the horizontal and vertical synchronization pulse rates and polarity.

5 Claims, 2 Drawing Sheets

AUTOMATIC PHASE ADJUSTMENT FOR DISPLAY

FIELD OF THE INVENTION

The present invention relates to LCD displays and in particular to automatically adjusting the phase of an analog LCD display based on horizontal and vertical sync pulses.

BACKGROUND OF THE INVENTION

LCD monitors are commonly used on lap-top computers. Such monitors convert an analog display signal such as one generated for a cathode ray tube (CRT) display to a digital signal to control individually addressable pixel elements. The LCD monitors are referred to as analog LCD monitors. Many applications such as games cause a change in the resolution and refresh rates of monitors to provide a better display of their output to a user. Autophase adjustments are initiated by a user when they notice interference on the display. The adjustment is initiated by pressing a button on the display or via a menu option.

Interference generally results when sync rates and polarities do not match the resolution and refresh rates of the display device. Some analog CRT monitors automatically adjust frequency and polarity of horizontal and vertical synchronization signals when the synchronization signals are changed. However no such automated adjustments are performed for LCD and other digital monitors converting analog display signals.

SUMMARY OF THE INVENTION

Autophase adjustment is initiated in a display device that digitally displays analog display signals. The autophase adjustment is initiated based on monitoring of at least one of the horizontal and vertical synchronization signal pulse rates and polarity. When a change is detected in either of the horizontal and vertical synchronization pulses, an autophase adjustment is automatically initiated.

In one embodiment, a micro-controller is used to monitor the horizontal and vertical synchronization pulses and initiate the autophase adjustment. Correct phase settings are obtained from a table of settings cross referenced by the horizontal and vertical synchronization pulse rates and polarity.

DETAILED DESCRIPTION OF THE INVENTION

In the following description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Figure 1:
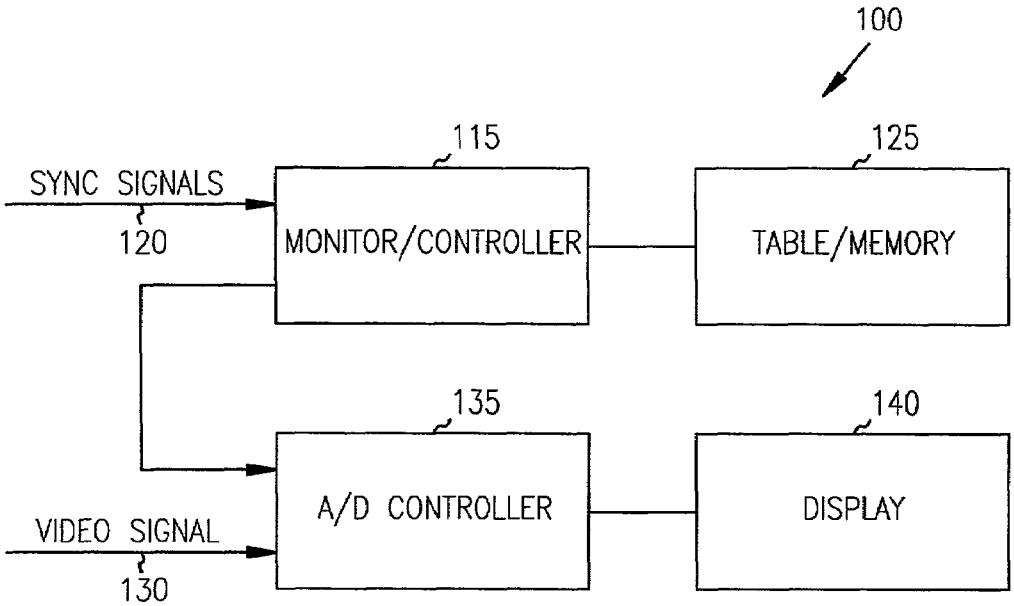
FIG. 1 is a block diagram of a computer system that performs a method of automatically adjusting the phase of an analog LCD display.

FIG. 1 is a block diagram of a system 100 for converting analog video signals provided via a VGA connection to digitized signals for display on a digitally addressable array of pixel elements. Autophase correction is provided by the system, which comprises an analog LCD, plasma or other type of similar display. In further embodiments, a computer system is directly coupled to the display such as in a laptop or other computer system having an integrated display.

System 100 comprises a monitor/controller 115 that receives vertical and horizontal synchronization signals 120 associated with a video signal 130. The monitor 115 monitors the pulse rate and polarity of at least one of the synchronization signals. It maintains values for them and compares previous values with current values. When a change is noticed, a phase adjustment is identified from a table/memory 125. Memory 125 is used in one embodiment both to store previous values, store information for the lookup tables, and to store programming required for operation of monitor 115. In one embodiment, monitor 115 comprises a microprocessor executing computer program instructions to carry out the monitoring and identification functions.

Once the new phase adjustment is known, it is provided to an analog to digital converter, A/D Controller 135, which is used to sample the video signal received on line 130. The sampling rate corresponds to the number of pixels in a display 140, and is keyed off the sync pulses and phase adjustment. The phase adjustment is an offset from the sync pulses corresponding to a stable time of the video signal during which accurate, sampling may be performed.

Many applications such as games cause a change in the resolution and refresh rates of monitors to provide a better display of their output to a user. These changes can cause the displayed images to deteriorate in quality. Such changes cause corresponding changes in the horizontal and vertical pulse rates and polarities. However, the changes are not independently communicated to an attached LCD analog monitor. The system of the present invention directly detects the changes and initiates autophase adjustments based on the changed sync pulse rates and polarities.

Figure 2:
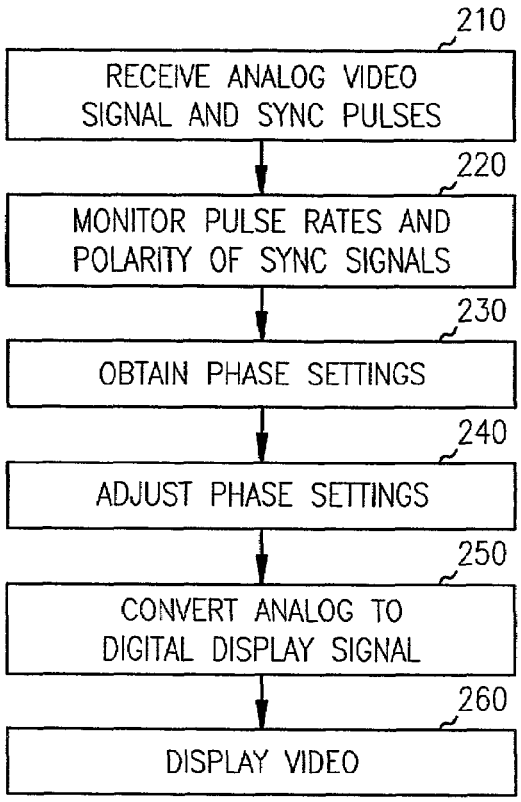
FIG. 2 is a block diagram of components in the computer system of FIG. 1 that provide monitoring of synchronization pulses and initiation of autophase.

A flowchart describing functions implemented to monitor the signals and implement autophase adjustment is provided in FIG. 2. At 210, the analog video signal is received from a video source, such as a computer system VGA or SVGA output port. In laptop computers, the port may be integrated directly with an analog LCD display, requiring conversion of the video to a digital format, such as by sampling of the video signal.

Synchronization signals are also received at 210. At 220, the horizontal and vertical synchronization signal pulse rates and polarities are monitored and compared to previous rates and polarities. If different, new phase setting are obtained from a table of known settings indexed by pulse rates and polarities. The phase settings are adjusted automatically at 240.

The new phase setting is used to delay sampling of the video signals from at least one of the synchronization pulses. This ensures that the video signals are sampled at a time when a reliable sample can be obtained. Transitions in the video signal are avoided during the sampling due to the modified phase. Once the signals are sampled and the analog video signal is converted to digital information corresponding to the individually addressable pixel elements of the display, the digital information is displayed on the display device.

Figure 3:
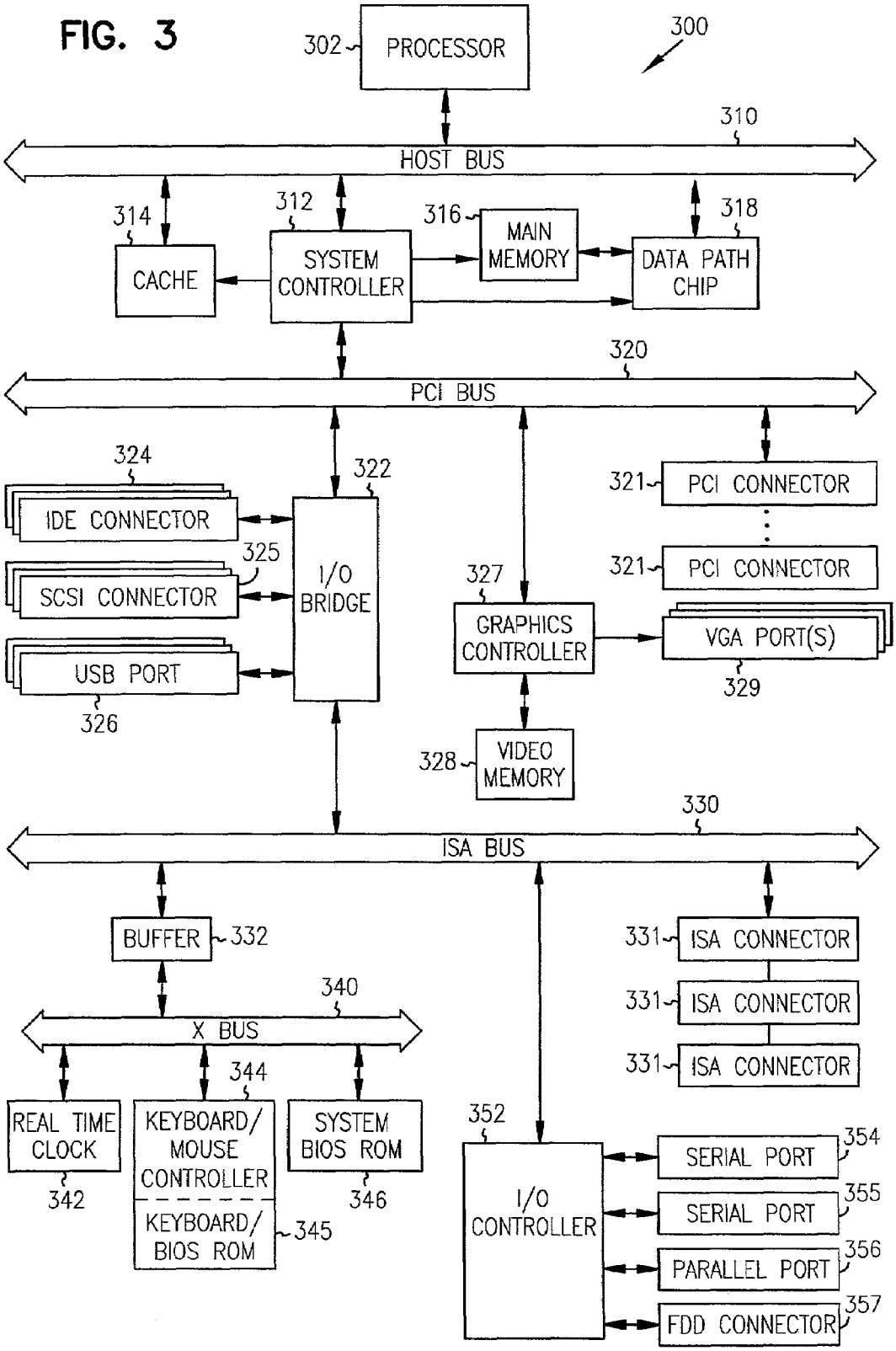
FIG. 3 is a detailed architectural block diagram of the computer system utilizing the current invention.

FIG. 3 is a block diagram of a computer system 300 that generates signals for a digital display device such as an LCD display. It also performs autophase adjustment for changing vertical or horizontal pulse rates and polarities when the analog LCD display is integrated into a laptop type of computer system. The monitor/controller 115 may also be formed out of a similar computer system as described below.

Computer system 300 comprises a processor 302, a system controller 312, a cache 314, and a data-path chip 318, each coupled to a host bus 310. Processor 302 is a microprocessor such as a 486-type chip, a Pentium®, Pentium® II, Pentium® III, Pentium® 4, or other suitable microprocessor. Cache 314 provides high-speed local-memory data (in one embodiment, for example, 512 kB of data) for processor 302, and is controlled by system controller 312, which loads cache 314 with data that is expected to be used soon after the data is placed in cache 314 (i.e., in the near future). Main memory 316 is coupled between system controller 312 and data-path chip 318, and in one embodiment, provides random-access memory of between 16 MB and 256 MB or more of data. In one embodiment, main memory 316 is provided on SIMMs (Single In-line Memory Modules), while in another embodiment, main memory 316 is provided on DIMMs (Dual In-line Memory Modules), each of which plugs into suitable sockets provided on a motherboard holding many of the other components shown in FIG. 3. Main memory 316 includes standard DRAM (Dynamic Random-Access Memory), EDO (Extended Data Out) DRAM, SDRAM (Synchronous DRAM), or other suitable memory technology. System controller 312 controls PCI (Peripheral Component Interconnect) bus 320, a local bus for system 300 that provides a high-speed data path between processor 302 and various peripheral devices, such as graphics devices, storage drives, network cabling, etc. Data-path chip 318 is also controlled by system controller 312 to assist in routing data between main memory 316, host bus 310, and PCI bus 320.

In one embodiment, PCI bus 320 provides a 32-bit-wide data path that runs at 33 MHz. In another embodiment, PCI bus 320 provides a 64-bit-wide data path that runs at 33 MHz. In yet other embodiments, PCI bus 320 provides 32-bit-wide or 64-bit-wide data paths that run at higher speeds. In one embodiment, PCI bus 320 provides connectivity to I/O bridge 322, graphics controller 327, and one or more PCI connectors 321 (i.e., sockets into which a card edge may be inserted), each of which accepts a standard PCI card. In one embodiment, I/O bridge 322 and graphics controller 327 are each integrated on the motherboard along with system controller 312, in order to avoid a board-connector-board signal-crossing interface and thus provide better speed and reliability. In the embodiment shown, graphics controller 327 is coupled to a video memory 328 (that includes memory such as DRAM, EDO DRAM, SDRAM, or VRAM (Video Random-Access Memory)), and drives VGA (Video Graphics Adaptor) port 329. VGA port 329 can connect to industry-standard monitors such as VGA-type, SVGA (Super VGA)-type, XGA-type (eXtended Graphics Adaptor) or SXGA-type (Super XGA) display devices.

In one embodiment, graphics controller 327 provides for sampling video signals in order to provide digital values for pixels. Autophase correction is provided by monitoring synchronization pulses and polarities, and looking up new phase corrections corresponding to the changes. In further embodiments, the video signal is provided via a VGA port 329 to an analog LCD display. The LCD display performs the monitoring, sampling and autophase adjustment as further described with respect to FIGS. 2 and 3.

Other input/output (I/O) cards having a PCI interface can be plugged into PCI connectors 321. Network connections providing video input are also represented by PCI connectors 321, and include Ethernet devices and cable modems for coupling to a high speed Ethernet network or cable network which is further coupled to the Internet.

In one embodiment, I/O bridge 322 is a chip that provides connection and control to one or more independent IDE or SCSI connectors 324-325, to a USB (Universal Serial Bus) port 326, and to ISA (Industry Standard Architecture) bus 330. In this embodiment, IDE connector 324 provides connectivity for up to two standard IDE-type devices such as hard disk drives, CDROM (Compact Disk-Read-Only Memory) drives, DVD (Digital Video Disk) drives, videocassette recorders, or TBU (Tape-Backup Unit) devices. In one similar embodiment, two IDE connectors 324 are provided, and each provide the EIDE (Enhanced IDE) architecture. In the embodiment shown, SCSI (Small Computer System Interface) connector 325 provides connectivity for up to seven or fifteen SCSI-type devices (depending on the version of SCSI supported by the embodiment). In one embodiment, I/O bridge 322 provides ISA bus 330 having one or more ISA connectors 331 (in one embodiment, three connectors are provided). In one embodiment, ISA bus 330 is coupled to I/O controller 352, which in turn provides connections to two serial ports 354 and 355, parallel port 356, and FDD (Floppy-Disk Drive) connector 357. At least one serial port is coupled to a modem for connection to a telephone system providing Internet access through an Internet service provider. In one embodiment, ISA bus 330 is connected to buffer 332, which is connected to X bus 340, which provides connections to real-time clock 342, keyboard/mouse controller 344 and keyboard BIOS ROM (Basic Input/Output System Read-Only Memory) 345, and to system BIOS ROM 346.

The integrated system performs several functions identified in the block diagram and flowchart of FIGS. 1 and 2. Such functions are implemented in software in one embodiment, where the software comprises computer executable instructions stored on computer readable media such as disk drives coupled to connectors 324 or 325, and executed from main memory 316 and cache 314. The term "computer readable medium" is also used to represent carrier waves on which the software is transmitted.

What is claimed is:

1. A system for displaying video signals, the system comprising:

a controller that monitors a pulse rate value and a polarity value of at least one of a vertical synchronization signal and a horizontal synchronization signal associated with a video signal, compares previous pulse rate and polarity values with current pulse rate and polarity values to detect a change in pulse rate and polarity values, and provides a phase adjustment signal in response to detecting a change in the pulse rate and polarity values, wherein the phase adjustment signal comprises a signal for delaying sampling of the video signal so that video signal is sampled at a time when a reliable signal can be obtained;

a table of phase adjustment signals coupled to the controller, wherein the table cross references phase adjustment signals with pulse rate and polarity values, and the phase adjustment signal provided by the controller is taken from the table of phase adjustment signals;

an analog-to-digital converter that receives the video signal and uses the phase adjustment signal to convert the video signal to a digital signal; and a display that receives the digital signal and displays images represented therein.

2. The system of claim 1 wherein the controller comprises a micro-controller.

3. The system of claim 1 wherein the display is selected from the group consisting of LCD, plasma and organic polymer displays.

4. A method of automatically adjusting phase for a LCD display, comprising the steps of:

monitoring at least one of a horizontal synchronization signal and a vertical synchronization signal associated with a video signal;

detecting an alteration in said at least one of the horizontal and vertical synchronization signals and determining a corresponding phase adjustment signal based on the detected alteration, the phase adjustment signal comprising a delay for sampling the video signal so that the video signal is sampled at a time when a reliable sample can be obtained; and supplying the video signal and phase adjustment signal to an analog-to-digital converter so as to produce a digital signal adjusted for optimal viewing of the LCD display, the monitoring and detecting steps further comprising comparing current and previous synchronization signals and initiating auto-phase correction upon detecting a change between the current and previous signals, and the auto-phase correction being obtained from a table of phase settings indexed by signal pulse rates and polarities.

5. The method of claim 4 wherein auto-phase correction is initiated based on a change in the horizontal or vertical synchronization signal polarity and pulse rates.

* * * * *